US009457567B2

(12) United States Patent
Torimoto et al.

(10) Patent No.: US 9,457,567 B2
(45) **Date of Patent: *Oct. 4, 2016**

(54) LIQUID EJECTING HEAD AND LIQUID EJECTING APPARATUS

(71) Applicant: Seiko Epson Corporation, Tokyo (JP)

(72) Inventors: Tatsuro Torimoto, Matsumoto (JP); Takahiro Kamijo, Matsumoto (JP); Motoki Takabe, Matsumoto (JP); Shiro Yazaki, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/743,004

(22) Filed: Jun. 18, 2015

(65) Prior Publication Data

US 2015/0283812 A1 Oct. 8, 2015

Related U.S. Application Data

(62) Division of application No. 13/957,680, filed on Aug. 2, 2013, now Pat. No. 9,090,063.

(30) Foreign Application Priority Data

Aug. 7, 2012 (JP) ..... 2012-174603

(51) Int. Cl.
*B41J 2/14* (2006.01)
*B41J 2/055* (2006.01)

(52) U.S. Cl.
CPC ..... *B41J 2/14201* (2013.01); *B41J 2/055* (2013.01); *B41J 2/14233* (2013.01); *B41J 2002/14241* (2013.01); *B41J 2002/14491* (2013.01)

(58) Field of Classification Search
None
See application file for complete search history.

(56) References Cited

U.S. PATENT DOCUMENTS 6,336,717 B1 * 1/2002 Shimada ..... B41J 2/14233 347/71
6,398,350 B2 * 6/2002 Kitahara ..... B41J 2/14274 347/70
6,502,928 B1 * 1/2003 Shimada ..... B41J 2/14233 347/68
6,862,783 B2 * 3/2005 Nishikawa ..... B41J 2/14233 156/250
7,175,262 B2 2/2007 Furuhata
2002/0126186 A1 * 9/2002 Takahagi ..... B41J 2/14274 347/70
2002/0180844 A1 * 12/2002 Takahagi ..... B41J 2/14274 347/70
2004/0263582 A1 * 12/2004 Sugahara ..... B41J 2/161 347/68
2006/0290747 A1 * 12/2006 Shimada ..... B41J 2/14233 347/68
2009/0231396 A1 9/2009 Yazaki
2011/0117311 A1 * 5/2011 Birkmeyer ..... B41J 2/161 428/80
2015/0231883 A1 * 8/2015 Hirai ..... B41J 2/14233 347/71

FOREIGN PATENT DOCUMENTS

JP 2009-148985 A 7/2009
JP 2010-208071 A 9/2010

* cited by examiner

*Primary Examiner* — Justin Seo

(57) ABSTRACT

Piezoelectric elements constituted by lower electrodes, piezoelectric layers, and an upper electrode are extended from positions corresponding to openings of pressure chambers to outer positions beyond opening edges of the pressure chambers. The piezoelectric layers have exposure portions on the extended portions and the exposure portions of the piezoelectric layers are covered by an adhesive between an actuator unit and a sealing plate.

9 Claims, 5 Drawing Sheets

LIQUID EJECTING HEAD AND LIQUID EJECTING APPARATUS

CONTINUING APPLICATION DATA

This application is a divisional of, and claims priority under 35 U.S.C. §120 on U.S. application Ser. No. 13/957,680, filed Aug. 2, 2013, which claims priority under 35 U.S.C. §119 on Japanese Patent Application No. 2012-174603, filed Aug. 7, 2012. The content of each application identified above is incorporated by reference herein in its entirety.

BACKGROUND

1. Technical Field

The present invention relates to a liquid ejecting head that ejects liquid by driving piezoelectric elements and a liquid ejecting apparatus including the liquid ejecting head. In particular, the invention relates to a liquid ejecting head and a liquid ejecting apparatus that are capable of suppressing damage of the piezoelectric elements.

2. Related Art

A liquid ejecting apparatus is an apparatus that includes a liquid ejecting head and ejects various types of liquids from the liquid ejecting head. As the liquid ejecting apparatuses, there are image recording apparatuses such as an ink jet printer and an ink jet plotter, for example. In recent years, the liquid ejecting apparatus is also applied to various types of manufacturing apparatuses by using such technology for the liquid ejecting apparatus that it can make an extremely small amount of liquid land at a predetermined position accurately. For example, the liquid ejecting apparatus is applied to a display manufacturing apparatus for manufacturing a color filter of a liquid crystal display and the like, an electrode forming apparatus for forming an electrode of an organic electro luminescence (EL) display, a field emission display (FED), and the like, and a chip manufacturing apparatus for manufacturing a biochip (biochemical element). Further, a recording head for the image recording apparatus ejects liquid-like ink and a coloring material ejecting head for the display manufacturing apparatus ejects solutions of coloring materials of red (R), green (G), and blue (B). An electrode material ejecting head for the electrode forming apparatus ejects a liquid-like electrode material and a bioorganic compound ejecting head for the chip manufacturing apparatus ejects a solution of a bioorganic compound.

The above-mentioned liquid ejecting head has a configuration in which liquid is introduced to pressure chambers, pressure fluctuation is generated on the liquid in the pressure chambers, and the liquid is ejected through nozzles communicating with the pressure chambers. The above-mentioned pressure chambers are formed on a crystalline substrate made of silicon or the like by anisotropic etching with high dimensional accuracy. Further, piezoelectric elements are used preferably as pressure generation units for generating the pressure fluctuation on the liquid in the pressure chambers. There are piezoelectric elements having various configurations. For example, each piezoelectric element is configured by forming a lower electrode at the side closer to the pressure chamber, a piezoelectric layer made of a piezoelectric material such as lead zirconium titanate (PZT) and an upper electrode in a laminated manner by a film formation technique. One of the upper and lower electrodes functions as an individual electrode provided for each pressure chamber and the other of them functions as a common electrode common to the plurality of pressure chambers. Portions of the piezoelectric layers that are sandwiched by the upper and lower electrodes correspond to active portions that are deformed by application of a voltage to the electrodes. Portions of the piezoelectric layers with which any one of the upper and lower electrodes is not overlapped or neither of the upper and lower electrodes is overlapped, correspond to passive portions that are not deformed by the application of a voltage to the electrodes.

Opening portions of the pressure chambers at one side (opposite side to the nozzle surface side) are closed by an elastic film made of $SiO_2$ and having flexibility, for example, and the piezoelectric elements are formed on the elastic film through an insulating film (for example, $ZrO_2$). The elastic film and the insulating film function as a vibration plate. In the existing technique, irregular and complicated deformation such as undulation of the piezoelectric elements and the vibration plate is generated on both end portions thereof in the lengthwise direction of the pressure chambers in some cases when the piezoelectric elements are driven. There has arisen a problem that liquid ejection stability is adversely influenced by the irregular and complicated deformation. Furthermore, a stress is concentrated on boundary portions between the active portions and the passive portions of the piezoelectric elements due to the irregular vibration and damage such as a crack is generated on the piezoelectric elements in some cases. In order to address this, for example, JP-A-2010-208071 (FIG. 2C) proposes a configuration in which a metal layer as a weight is provided on the upper electrode (second conductive layer) so as to suppress irregular vibration on the end portions of the piezoelectric elements. In the configuration as described in JP-A-2010-208071 (FIG. 2C), lead electrode portions (fourth conductive layers) that are electrically connected with the lower electrodes (first conductive layers) are provided in the vicinity of one end portion of the upper electrode with slight spaces between the lead electrode portions and the upper electrode and piezoelectric layers are exposed therebetween.

In the manufacturing process of the liquid ejecting head as described in JP-A-2010-208071 (FIG. 2C), when the pressure chambers are formed on the single-crystal silicon substrate by anisotropic etching processing, a pressure chamber plate before the pressure chambers are formed thereon is immersed in an etchant such as potassium hydroxide (KOH). To be more specific, the pressure chamber plate is immersed in a state where the vibration plate and the piezoelectric elements have been laminated and formed on the surface (upper surface) of the pressure chamber plate, which is opposite to the surface (lower surface) on which etching is to be performed. In the liquid ejecting head manufactured through the process, a phenomenon that the piezoelectric layers on the above-mentioned exposure portions are burned out has occurred. The piezoelectric elements are immersed in the etchant in a state of being sealed by a protection member called sealing plate and being further protected by a protection sheet through which liquid does not penetrate. However, hydrogen gas generated at the time of etching reaction penetrates through the protection sheet and the sealing plate and comes around the side of the piezoelectric elements in some cases. If the hydrogen gas reacts with the exposure portions of the piezoelectric layers to melt the piezoelectric layers, leakage of an electric current occurs between the upper electrode (or metal layer thereon) and the lead electrode portions easily. Consequently, due to this electric leakage, it is considered that the piezoelectric layers on the above-mentioned exposure portions are burned out.

SUMMARY

An advantage of some aspects of the invention is to provide a liquid ejecting head and a liquid ejecting apparatus that are capable of suppressing burnout of piezoelectric elements.

A liquid ejecting head according to an aspect of the invention includes a pressure chamber formation member on which a pressure chamber communicating with a nozzle is formed, an actuator unit that includes a piezoelectric element formed by laminating a first electrode, a piezoelectric layer, and a second electrode in this order at a position corresponding to the pressure chamber and is laminated on the pressure chamber formation member, and a sealing member that is bonded to the actuator unit with an adhesive in a state where the piezoelectric element is accommodated in an accommodation cavity formed in the sealing member. In the liquid ejecting head, the piezoelectric element is extended from a position corresponding to an opening of the pressure chamber to an outer position beyond an opening edge of the pressure chamber, and the piezoelectric layer includes an exposure portion on which the second electrode is removed on the extended portion, and the exposure portion of the piezoelectric layer is covered by the adhesive between the actuator unit and the sealing member.

With this configuration, the exposure portion of the piezoelectric layer is covered by the adhesive between the actuator unit and the sealing member. Therefore, even if hydrogen gas generated when the pressure chamber is formed on the pressure chamber formation member by anisotropic etching comes around the piezoelectric element side, the exposure portion of the piezoelectric layer is not exposed to the hydrogen gas. This prevents the piezoelectric layer from reacting with the hydrogen gas to be melted. As a result, leakage of an electric current is suppressed between the electrodes provided in the vicinity of the exposure portion, thereby preventing burnout of the piezoelectric layer.

In the above-mentioned configuration, it is preferable that a bonding portion of the sealing member to the actuator unit be overlapped with the exposure portion of the piezoelectric layer in a lamination direction of a sealing plate and the actuator unit.

With this configuration, the bonding portion of the sealing member to the actuator unit is overlapped with the exposure portion of the piezoelectric layer in the lamination direction of the sealing plate and the actuator unit. Therefore, the exposure portion of the piezoelectric layer is covered and protected by the adhesive and the sealing member itself between the pressure chamber formation member and the sealing member more reliably.

Further, in the aspect of the invention, it is preferable that the exposure portion of the piezoelectric layer be located between a terminal portion which is formed on an end portion of the extended portion of the piezoelectric element and is electrically connected with the first electrode and the second electrode.

That is to say, also in the configuration in which the exposure portion is located between the terminal portion and the second electrode, the exposure portion is covered by the adhesive. Therefore, leakage of the electric current is suppressed between the terminal portion and the second electrode, thereby preventing burnout of the piezoelectric layer.

Further, in the above-mentioned configuration, it is preferable that a metal film made of the same material as the terminal portion be formed on an end portion of the second electrode opposed to the terminal portion while sandwiching the exposure portion therebetween, and a surface of the metal film and a surface of the terminal portion be aligned on the same plane, and the bonding portion of the sealing member abut against the second electrode and the terminal portion across the exposure portion of the piezoelectric layer so that a position of the sealing member with respect to the actuator unit in a lamination direction is defined.

In the configuration, the bonding portion of the sealing member abuts against the metal film and the terminal portion across the exposure portion of the piezoelectric layer. With this, the position of the sealing member with respect to the actuator unit in the lamination direction is defined stably. Therefore, the exposure portion can be covered by the adhesive more reliably, thereby improving the yield.

Further, a liquid ejecting apparatus according to another aspect of the invention includes the liquid ejecting head having the above-mentioned configuration.

With this configuration, burnout of the piezoelectric element on the liquid ejecting head is suppressed, so that reliability of the apparatus is improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, modes for executing the invention are described with reference to the accompanying drawings. In the embodiment which will be described below, various limitations are made as a preferable specific example of the invention. However, the scope of the invention is not limited to the modes unless otherwise description limiting the invention is made explicitly in the following description. Further, in the following description, an ink jet printer (hereinafter, printer) on which an ink jet recording head (hereinafter, recording head) as one type of a liquid ejecting head is mounted is described as an example of a liquid ejecting apparatus according to the invention.

Figure 1:
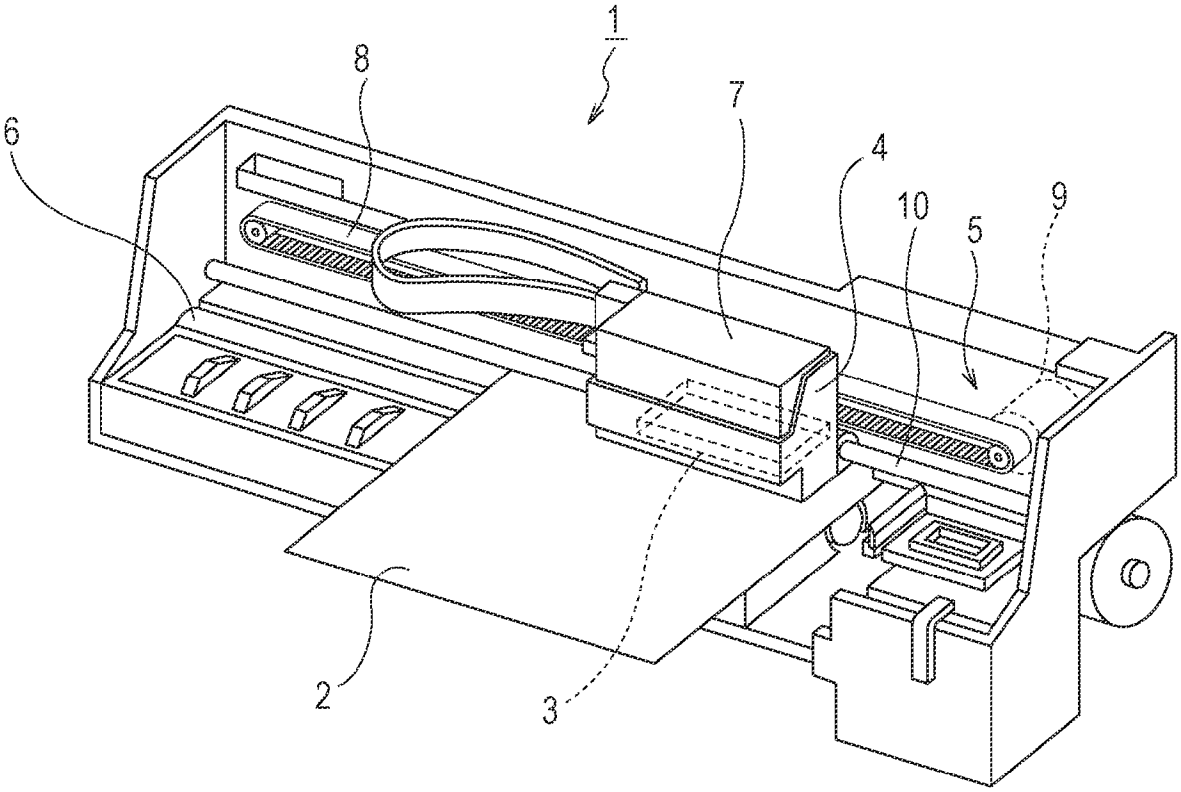
FIG. 1 is a perspective view illustrating an inner configuration of a printer.

A configuration of a printer 1 is described with reference to FIG. 1. The printer 1 is an apparatus that ejects liquid-like ink onto the surface of a recording medium 2 (one type of landing target) such as a recording sheet and performs recording of images and the like. The printer 1 includes a recording head 3, a carriage 4, a carriage movement mechanism 5, a transportation mechanism 6, and the like. The recording head 3 is attached to the carriage 4. The carriage movement mechanism 5 moves the carriage 4 in the main-scanning direction. The transportation mechanism 6 transports the recording medium 2 in the sub-scanning direction. The above-mentioned ink is one type of liquid in the invention and is stored in an ink cartridge 7 as a liquid supply source. The ink cartridge 7 is attached to the recording head 3 in a detachable manner. Note that a configuration in which the ink cartridge 7 is arranged on a main body of the printer 1 and ink is supplied to the recording head 3 through an ink supply tube from the ink cartridge 7 can be employed.

The above-mentioned carriage movement mechanism 5 includes a timing belt 8. The timing belt 8 is driven by a pulse motor 9 such as a DC motor. If the pulse motor 9 is operated, the carriage 4 is guided by a guide rod 10 provided to extend to both the sides of the printer 1 and reciprocates in the main-scanning direction (width direction of the recording medium 2).

Figure 2:
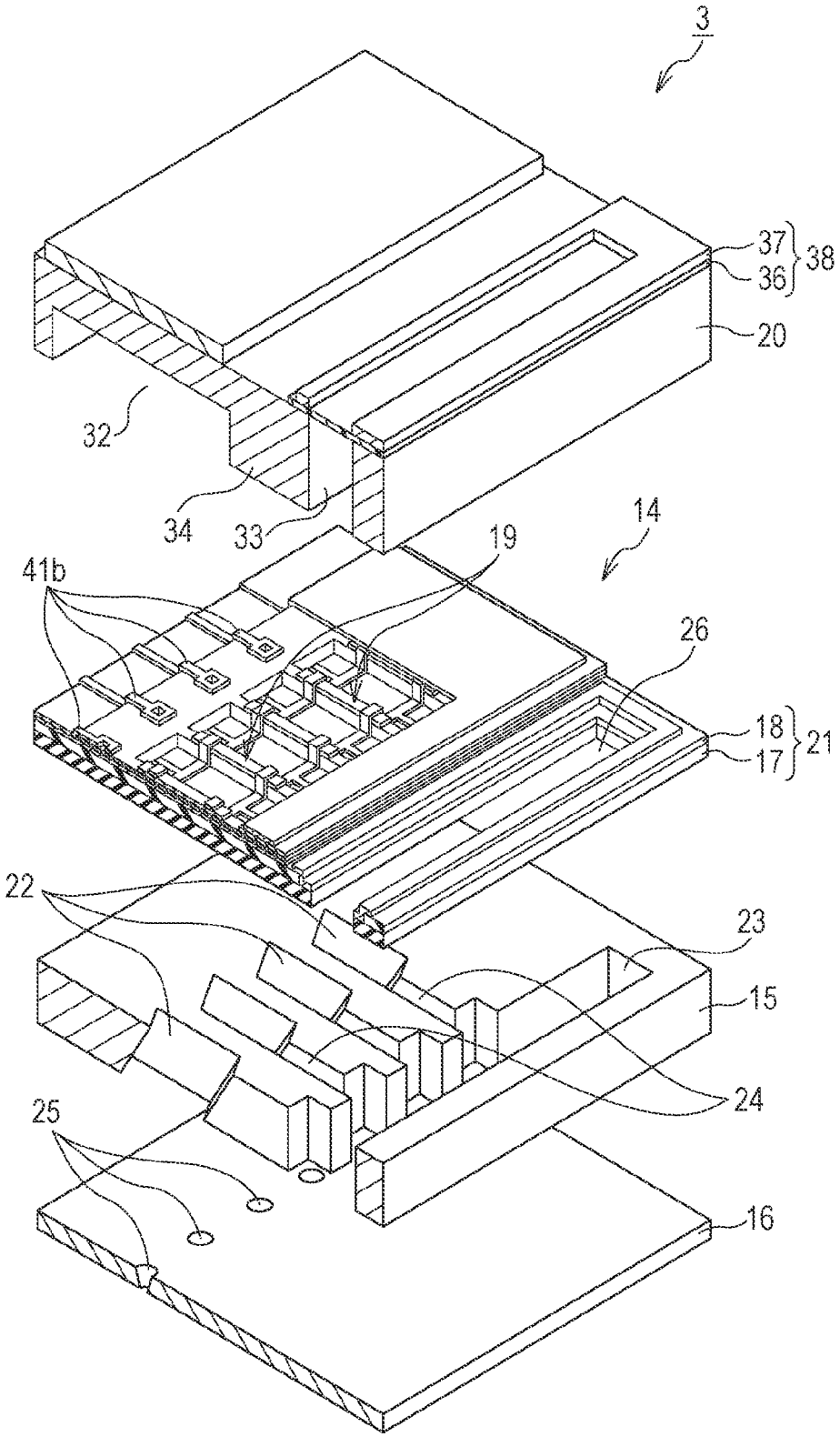
FIG. 2 is an exploded perspective view illustrating a recording head.
Figure 3:
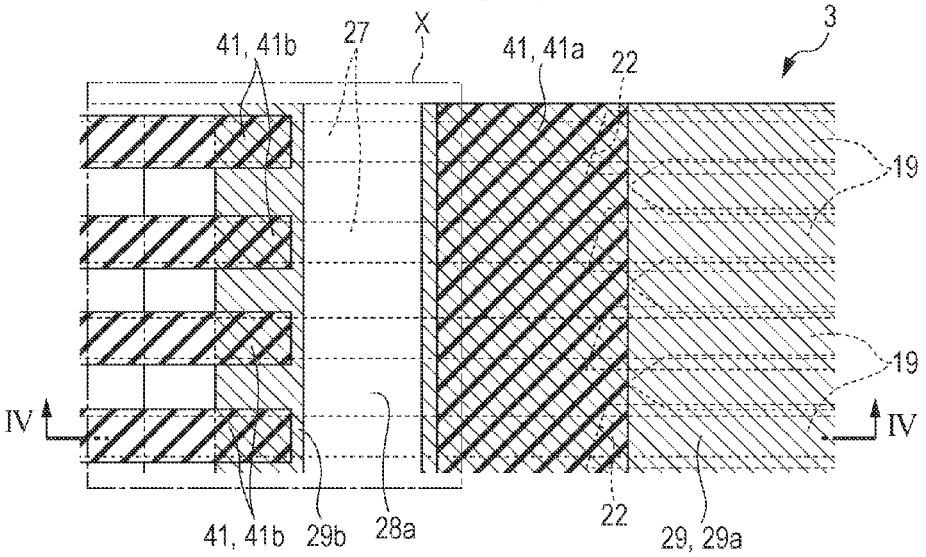
FIG. 3 is a plan view illustrating the recording head.
Figure 4:
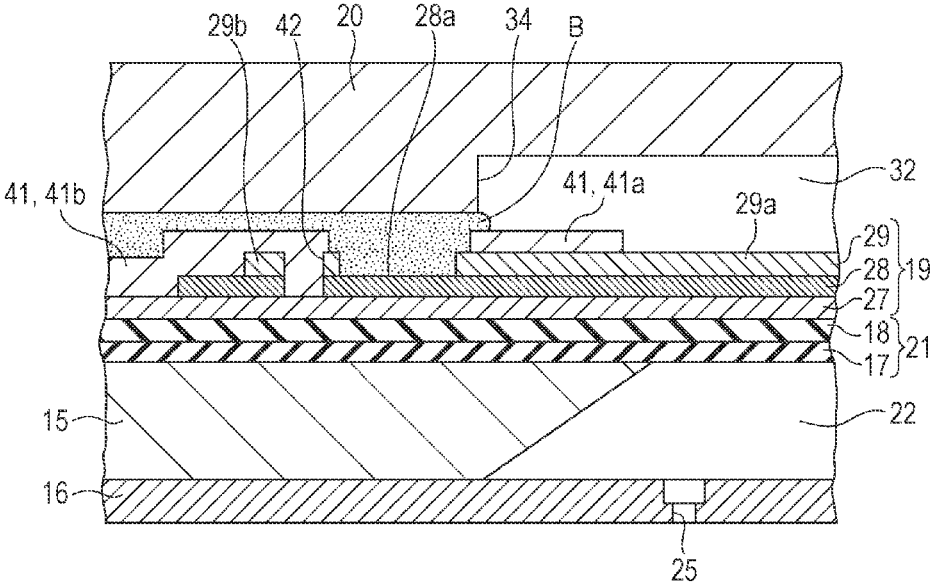
FIG. 4 is a cross-sectional view cut along a line IV-IV in FIG. 3.

FIG. 2 is an exploded perspective view illustrating a configuration of the recording head 3 according to the embodiment. FIG. 3 is a plan view of the recording head 3 and FIG. 4 is a cross-sectional view cut along a line IV-IV in FIG. 3. It is to be noted that FIG. 3 illustrates a state where a sealing plate 20, which will be described later, is not bonded. In FIG. 3, portions hatched with thin lines correspond to an upper electrode 29 and portions hatched with thick lines correspond to a metal layer 41 (both will be described later). Further, FIG. 3 and FIG. 4 illustrate a portion corresponding to one end portion (end portion at the side opposite to ink supply paths 24) in the lengthwise direction of pressure chambers 22 (direction orthogonal to the nozzle row direction).

The recording head 3 according to the embodiment is configured by laminating a flow path formation substrate 15 (one type of a pressure chamber formation member in the invention), a nozzle plate 16, an actuator unit 14, the sealing plate 20 (one type of a sealing member in the invention), and the like.

The flow path formation substrate 15 is a plate member made of a single-crystal silicon substrate having a plane orientation (110) in the embodiment. The plurality of pressure chambers 22 are formed on the flow path formation substrate 15 by anisotropic etching so as to be aligned in the nozzle row direction. In the embodiment, the pressure chambers 22 are cavities having openings of parallelogram elongated in the direction orthogonal to the nozzle row direction. The pressure chambers 22 are provided so as to correspond to nozzles 25 on the nozzle plate 16 on a one-to-one basis. That is to say, a formation pitch of the pressure chambers 22 corresponds to a formation pitch of the nozzles 25. Further, as illustrated in FIG. 2, a communication portion 23 is formed on the flow path formation substrate 15 along the parallel arrangement direction of the pressure chambers 22. To be more specific, the communication portion 23 is formed at a region apart from the pressure chambers 22 laterally (to the side opposite to the nozzle communication side) in the lengthwise direction of the pressure chambers. The communication portion 23 penetrates through the flow path formation substrate 15. The communication portion 23 is a cavity common to the respective pressure chambers 22. The communication portion 23 and the respective pressure chambers 22 communicate with each other through the ink supply paths 24. It is to be noted that the communication portion 23 communicates with a communication opening 26 of a vibration plate 21 and a liquid chamber cavity 33 of the sealing plate 20, which will be described later, so as to constitute a reservoir (common liquid chamber). The reservoir (common liquid chamber) is an ink chamber common to the respective pressure chambers 22. The ink supply paths 24 are formed so as to have widths smaller than those of the pressure chambers 22. The ink supply paths 24 are portions functioning as flow path resistances to ink flowing into the pressure chambers 22 from the communication portion 23.

The nozzle plate 16 is bonded to the lower surface of the flow path formation substrate 15 (surface at the side opposite to the bonding surface to the actuator unit 14) through an adhesive, a thermal welding film, or the like. The nozzle plate 16 is a plate member on which the plurality of nozzles 25 are opened in a row at a predetermined pitch. In the embodiment, 360 nozzles 25 are arranged in a row at a pitch corresponding to 360 dpi so as to constitute a nozzle row (one type of a nozzle group). The respective nozzles 25 communicate with the pressure chambers 22 on the end portions at the side opposite to the ink supply paths 24. It is to be noted that the nozzle plate 16 is made of a glass ceramic, a single-crystal silicon substrate, a stainless steel, or the like.

The actuator unit 14 in the embodiment is configured by the vibration plate 21, piezoelectric elements 19, and the metal layer 41. The vibration plate 21 is formed by an elastic film 17 and an insulating film 18. The elastic film 17 is formed on the upper surface of the flow path formation substrate 15 and is made of silicon dioxide ($SiO_2$). The insulating film 18 is formed on the elastic film 17 and is made of zirconium oxide ($ZrO_2$). A portion of the vibration plate 21, which corresponds to the pressure chambers 22, that is, a portion closing the upper openings of the pressure chambers 22, is displaced in the direction further from or closer to the nozzles 25 with flexural deformation of the piezoelectric elements 19. The communication opening 26 communicating with the communication portion 23 is opened on a portion of the vibration plate 21, which corresponds to the communication portion 23 of the flow path formation substrate 15.

The piezoelectric elements 19 are formed on portions of the insulating film 18 of the vibration plate 21, which correspond to the pressure chambers 22. The piezoelectric elements 19 in the embodiment are configured by laminating lower electrodes 27 (corresponding to a first electrode in the invention), piezoelectric layers 28, and an upper electrode 29 (corresponding to a second electrode in the invention) in this order from the vibration plate 21 side. Further, the piezoelectric elements 19 are extended on the insulating film 18 to the positions apart toward the outer side beyond upper opening edges (opening edges at the side communicating with the nozzles 25) of the pressure chambers 22 in the lengthwise direction of the pressure chambers 22. The lower electrodes 27 and the piezoelectric layers 28 are further extended to the outer side in the same direction relative to the end portion of a main body portion 29*a* of the upper electrode 29 in the lengthwise direction of the pressure chambers.

In the embodiment, the lower electrodes 27 and the piezoelectric layers 28 are patterned for the respective pressure chambers 22. The lower electrodes 27 are individual electrodes for the respective piezoelectric elements 19. Further, the upper electrode 29 is an electrode common to the respective piezoelectric elements 19. Portions with which the upper electrode 29, the piezoelectric layers 28, and the lower electrodes 27 are overlapped in the lamination direction correspond to piezoelectric active portions on which piezoelectric strain is generated due to application of the voltage to these electrodes. That is to say, the upper electrode 29 is a common electrode of the piezoelectric elements 19 and the lower electrodes 27 are individual electrodes of the piezoelectric elements 19. It is to be noted that these electrodes can be configured to be inversed in view of the convenience of the driving circuits and wirings.

The upper electrode 29 is constituted by the main body portion 29*a* defining the piezoelectric active portions and a conductive portion 29*b* independent of the main body portion 29*a*. The conductive portion 29*b* is formed on the piezoelectric layers 28 on a region apart toward the outer side relative to the upper opening edges of the pressure chambers 22 in the lengthwise direction of the pressure chambers. To be more specific, the conductive portion 29*b* is formed at a position distanced from the main body portion 29*a* by a predetermined space. As illustrated in FIG. 4, through-holes 42 reaching the lower electrodes 27 from the upper surface of the conductive portion 29*b* are formed in a state of penetrating through the conductive portion 29*b* and the piezoelectric layers 28.

The metal layer 41 made of gold (Au) is formed on the upper electrode 29 through an adhesion layer (for example, NiCr) (not illustrated). The metal layer 41 is constituted by a weight portion 41*a* (corresponding to a metal film in the invention) and lead electrode portions 41*b* (corresponding to one type of terminal portion in the invention). The weight portion 41*a* is formed on the main body portion 29*a* of the upper electrode 29 at an outer region relative to the upper opening edges of the pressure chambers 22 in the lengthwise direction of the pressure chambers. The weight portion 41*a* restricts displacement of the end portions of the piezoelectric elements 19 in the lengthwise direction thereof so as to suppress irregular displacement of the piezoelectric elements 19 and the vibration plate 21 during driving. It is to be noted that a configuration without the weight portion 41*a* can be employed. The lead electrode portions 41*b* are patterned so as to correspond to the lower electrodes 27 as the individual electrodes. The lead electrode portions 41*b* are formed such that at least parts of them are overlapped with the upper part of the conductive portion 29*b*. The lead electrode portions 41*b* are electrically connected with the lower electrodes 27 through the above-mentioned through-holes 42. A driving voltage (driving pulse) is applied to the respective piezoelectric elements 19 through the lead electrode portions 41*b* selectively. The weight portion 41*a* and the lead electrode portions 41*b* are formed by the same process and the upper surfaces (surfaces) thereof are aligned on the same plane.

In the recording head 3 having such configuration, the upper electrode 29 is removed and parts of the piezoelectric layers 28 are exposed on a region between the main body portion 29*a* and the conductive portion 29*b* of the upper electrode 29 or regions between the weight portion 41*a* and the lead electrode portions 41*b* (in the configuration without the weight portion 41*a*, between the main body portion 29*a* of the upper electrode 29 and the lead electrode portions 41*b*). Hereinafter, the exposure portions of the piezoelectric layers 28 on which the upper electrode 29 and the metal layer 41 are not formed are referred to as exposure portions 28*a*.

The sealing plate 20 is bonded to the upper surface of the actuator unit 14 at the side opposite to the lower surface as the bonding surface to the flow path formation substrate 15. The sealing plate 20 has an accommodation cavity 32 capable of accommodating the piezoelectric elements 19. The sealing plate 20 is a hollow box-shaped member with the accommodation cavity 32 that is opened on the lower surface of the sealing plate 20 as the bonding surface to the actuator unit 14. The above-mentioned accommodation cavity 32 is a recess formed halfway in the height direction of the sealing plate 20 from the lower surface side to the upper surface side of the sealing plate 20. The dimension (inner dimension) of the accommodation cavity 32 in the nozzle row direction is set to a size capable of accommodating all the piezoelectric elements 19 on the same row. Further, the dimension of the accommodation cavity 32 in the direction orthogonal to the nozzle row is set to be larger than the dimensions of the pressure chambers 22 in the same direction (lengthwise direction) and to be smaller than the dimensions of the piezoelectric layers 28 in the same direction. Further, as illustrated in FIG. 2, the liquid chamber cavity 33 is provided on the sealing plate 20. The liquid chamber cavity 33 is provided at a position apart toward the outer side relative to the accommodation cavity 32 in the direction orthogonal to the nozzle row. To be more specific, the liquid chamber cavity 33 is provided on a region corresponding to the communication opening 26 of the vibration plate 21 and the communication portion 23 of the flow path formation substrate 15. The liquid chamber cavity 33 is provided along the parallel arrangement direction of the pressure chambers 22 so as to penetrate through the sealing plate 20 in the thickness direction. The liquid chamber cavity 33 communicates with the communication opening 26 and the communication portion 23 continuously so as to define the reservoir as the common ink chamber to the respective pressure chambers 22 as described above.

A compliance substrate 38 formed by a sealing film 36 and a fixing plate 37 is bonded onto the sealing plate 20. The sealing film 36 is made of a material (for example, polyphenylene sulfide film) having flexibility and low rigidity. One surface of the liquid chamber cavity 33 is sealed by the sealing film 36. Further, the fixing plate 37 is made of a hard material (for example, stainless steel or the like) such as a metal. A region of the fixing plate 37 that is opposed to the reservoir corresponds to the communication opening 26 from which the fixing plate 37 is removed completely in the thickness direction. Therefore, one surface of the reservoir is sealed by only the sealing film 36 having flexibility.

Although not illustrated in the drawings, a wiring opening that penetrates through the sealing plate 20 in the thickness direction is provided on the sealing plate 20 in addition to the accommodation cavity 32 and the liquid chamber cavity 33. The end portions of the lead electrode portions 41*b* are exposed in the wiring openings. Terminals of wiring members (not illustrated) from the printer main body are electrically connected to the exposure portions of the lead electrode portions 41*b*. Further, in order to adjust the inner portion of the accommodation cavity 32 to the atmospheric pressure, an air communication port that makes the accommodation cavity 32 communicate with the outside of the sealing plate 20 is provided on the sealing plate 20.

The above-mentioned accommodation cavity 32 and liquid chamber cavity 33 are partitioned by a partition wall 34. The lower surface (corresponding to a bonding portion in the invention) of the sealing plate 20 including the lower end surface of the partition wall 34 is bonded to the upper surface of the actuator unit 14 with an adhesive B as illustrated in FIG. 4. The adhesive B is formed with epoxy-based adhesive, for example, and is previously applied to the lower surface of the sealing plate 20 by transfer processing. The thickness of the adhesive B is adjusted to equal to or larger than 1.0 μm and equal to or smaller than 3.0 μm. When the sealing plate 20 and the actuator unit 14 are bonded, the lower end surface of the partition wall 34 is arranged in a state of being overlapped with a region as indicated by "X" in FIG. 3 and is bonded to the actuator unit 14 in the region. To be more specific, as illustrated in FIG. 4, the partition wall 34 is bonded to the actuator unit 14 across the portion between at least the main body portion 29*a* of the upper electrode 29 or the weight portion 41*a* and the lead electrode portions 41*b*. With this, the exposure portions 28*a* of the piezoelectric layers 28 that are exposed between the main body portion 29*a* of the upper electrode 29 or the weight portion 41*a* and the lead electrode portions 41*b* are covered by the adhesive B. In this manner, the exposure portions 28*a* of the piezoelectric layers 28 are covered and protected by the adhesive B, so that even if hydrogen gas generated when the pressure chambers 22 are formed on the pressure chamber formation member 15 by anisotropic etching comes around the side of the piezoelectric elements 19, the exposure portions 28*a* are not exposed to the hydrogen gas. This prevents the piezoelectric layers 28 from reacting with the hydrogen gas to be melted. As a result, leakage of an electric current is suppressed between the main body portion 29*a* of the upper electrode 29 or the weight portion 41*a* and the lead electrode portions 41*b*, thereby preventing burnout of the piezoelectric layers 28.

The end portions of the piezoelectric elements 19 extended to the outer side relative to the opening edges of the pressure chambers 22 in the lengthwise direction are protected by the sealing plate 20 and the adhesive B in the above manner. With this, the adhesive B and the sealing plate 20 are overlapped with the exposure portions 28*a* of the piezoelectric layers 28 in the lamination direction of the sealing plate and the actuator unit, so that the exposure portions 28*a* are covered and protected by the adhesive B and the sealing plate 20 more reliably. In addition, irregular deformation on the corresponding end portions is suppressed when the piezoelectric elements 19 are driven, thereby suppressing generation of damage such as a crack on the piezoelectric elements 19 due to the irregular deformation.

Further, in the embodiment, the lower end surface of the partition wall 34 is bonded to the weight portion 41*a* and the lead electrode portions 41*b* having upper end surfaces of which heights are aligned on the same plane in the abutment state. Therefore, the position of the sealing plate 20 with respect to the actuator unit 14 in the lamination direction is defined stably. This makes it possible to cover the exposure portions 28 with the adhesive B more reliably, thereby improving the yield. Note that the adhesive B has a disadvantage that an adhesion force to the metal layer 41 made of Au is weak. However, in the embodiment, the partition wall 34 is bonded to materials other than that of the metal layer 41, for example, to various materials of the adhesion layer, the piezoelectric layers 28, the upper electrode 29, and the like, thereby suppressing delamination.

It is to be noted that since the lead electrode portions 41*b* are not provided on the portions of the piezoelectric elements 19 (end portions at the ink supply path 24 side) corresponding to the other end portions of the pressure chambers 22 in the lengthwise direction thereof, a risk of the leakage of the electric current is made less. However, it is needless to say that the portions of the piezoelectric elements 19 are desirably covered by the sealing plate 20 and the adhesive B in order to protect the piezoelectric layers 28 and prevent a crack and the like from being generated on the end portions of the piezoelectric elements 19.

Described is a manufacturing method of the above-mentioned recording head 3.

Figure 5A:
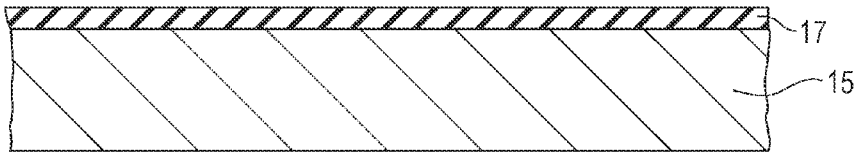
FIGS. 5A to 5E are primary cross-sectional views illustrating a manufacturing process of the recording head.
Figure 5B:
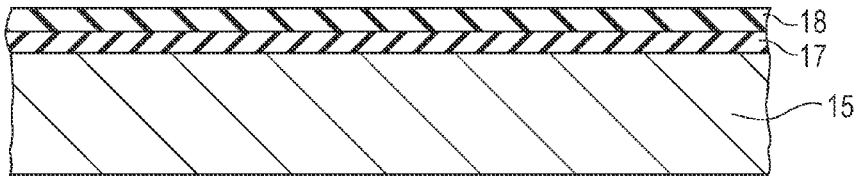
Figure 5C:
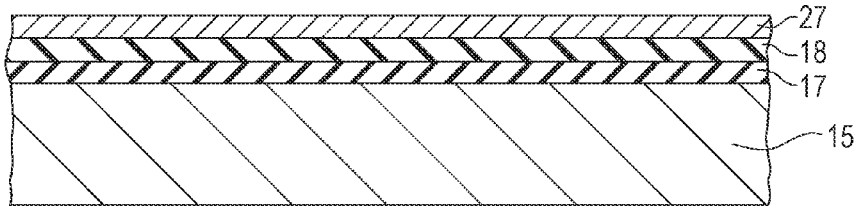

First, as illustrated in FIG. 5A, the single-crystal silicon substrate forming the flow path formation substrate 15 is thermally oxidized in a diffusion furnace at approximately 1100° C. and a silicon dioxide ($SiO_2$) film forming the elastic film 17 is formed on the surface of the flow path formation substrate 15. Next, as illustrated in FIG. 5B, the insulating film 18 made of zirconium oxide ($ZrO_2$) is formed on the elastic film 17. To be more specific, first, a zirconium layer is formed on the elastic film 17 by a DC sputtering method, for example, and the insulating film 18 made of zirconium oxide is formed by thermally oxidizing the zirconium layer. Then, as illustrated in FIG. 5C, for example, platinum (Pt) and iridium (Ir) are laminated on the insulating film 18 so as to form the lower electrodes 27. The lower electrodes 27 are patterned so as to have widths smaller than those of the pressure chambers 22.

Figure 5D:
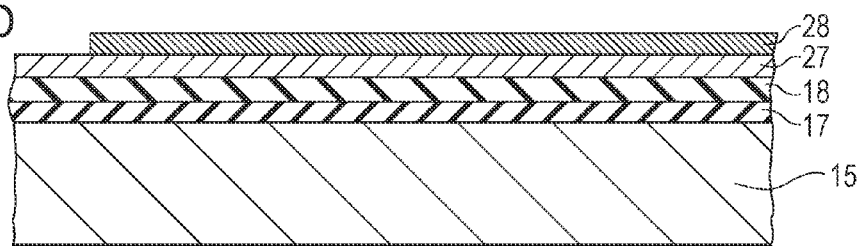
Figure 5E:
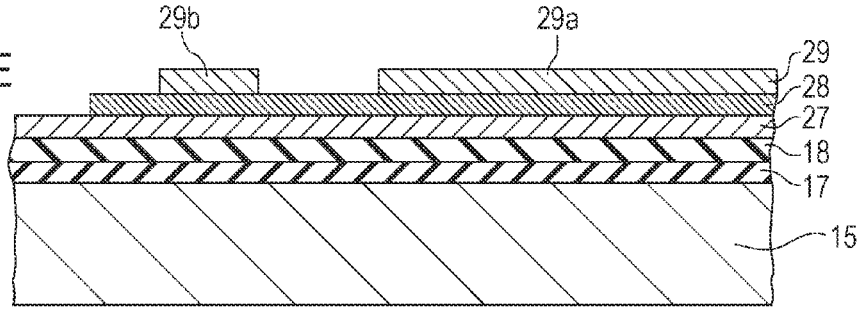

Subsequently, as illustrated in FIG. 5D, the piezoelectric layers 28 made of lead zirconate titanate (PZT) are laminated on the surfaces of the lower electrodes 27. The formation method of the piezoelectric layers 28 is as follows in the embodiment. The piezoelectric layers 28 are formed by using a so-called sol-gel method in which sol obtained by dissolving and dispersing a metal organic material in a solvent is applied and dried to be turned into gel and the gel is baked at a high temperature. The formation method of the piezoelectric layers 28 is not particularly limited and an MOD method, a sputtering method, and the like can be used. The piezoelectric layers 28 are patterned so as to have widths smaller than those of the pressure chambers 22 as in the lower electrodes 27. Subsequently, as illustrated in FIG. 5E, the upper electrode 29 made of iridium, for example, is formed on the upper surfaces of the piezoelectric layers 28 by sputtering or the like. The upper electrode 29 is patterned into the main body portion 29*a* and the conductive portion 29*b*.

Figure 6A:
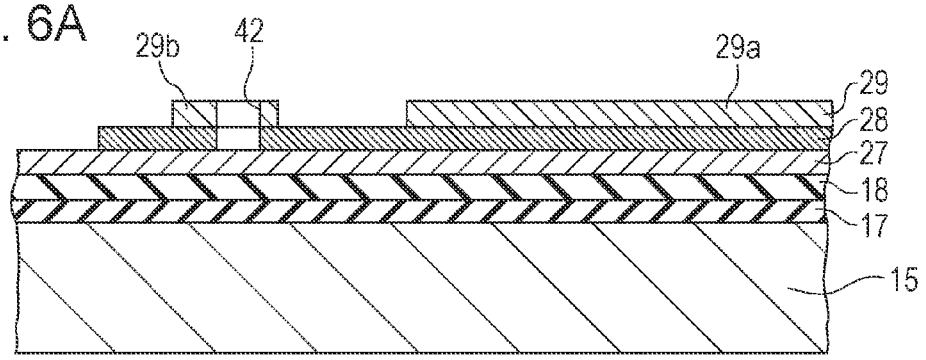
FIGS. 6A to 6C are primary cross-sectional views illustrating the manufacturing process of the recording head.
Figure 6B:
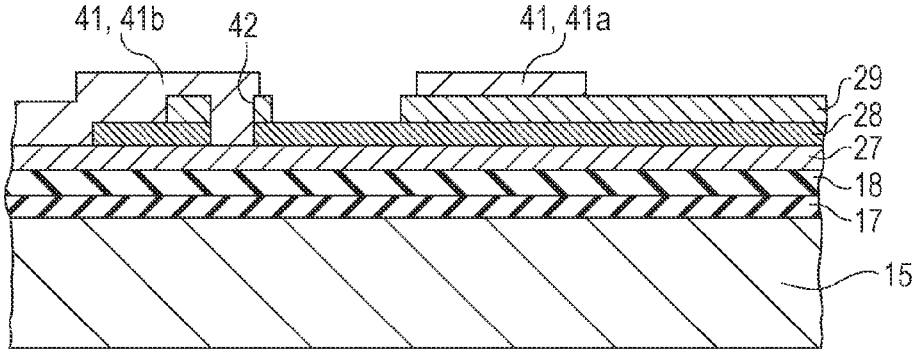
Figure 6C:
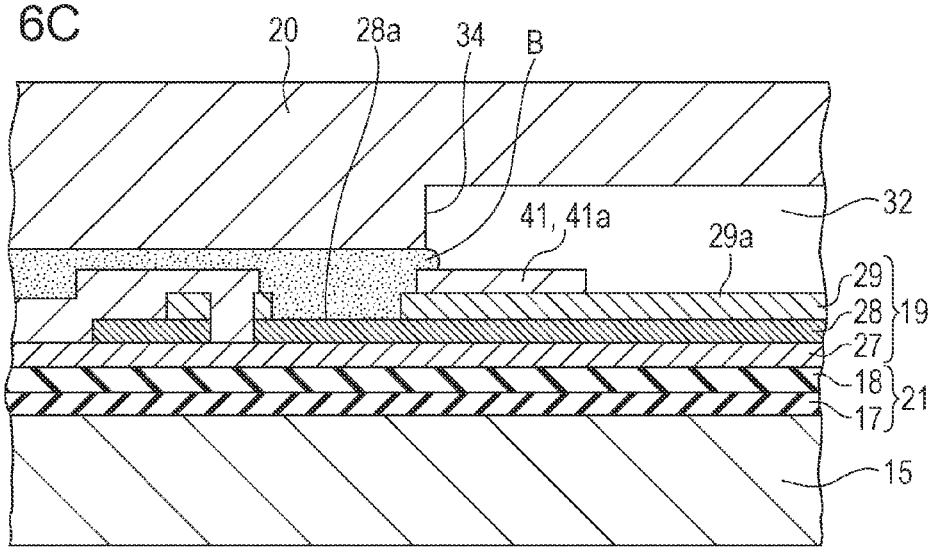

Next, as illustrated in FIG. 6A, the through-holes 42 are opened on the conductive portion 29*b* and the piezoelectric layers 28. Subsequently, as illustrated in FIG. 6B, the metal layer 41 is formed on the upper electrode 29 through the adhesion layer (not illustrated) by a sputtering method, a vacuum evaporation method, a CVD method, or the like. The metal layer 41 is patterned into the weight portion 41*a* and the lead electrode portions 41*b* by etching or the like. Subsequently, the sealing plate 20 is bonded to the actuator unit 14. As described above, when the sealing plate 20 and the actuator unit 14 are bonded, the lower end surface of the partition wall 34 is bonded to the actuator unit 14 in a state of being overlapped with the exposure portions 28*a* of the piezoelectric layers 28 in the lamination direction of the sealing plate 20 and the actuator unit 14. Therefore, the exposure portions 28*a* of the piezoelectric layers 28 are covered by the sealing plate 20 and the adhesive B. Thereafter, in a state where the actuator unit 14 and the sealing plate 20 are covered by a protection sheet (not illustrated), the recording head 3 in the state before the pressure chambers 22 are formed is immersed in the etchant. With this, flow paths such as the pressure chambers 22 and the ink supply paths 24 are formed on the flow path formation substrate 15 by etching. In this case, even if the hydrogen gas generated by the etching reaction penetrates through the protection sheet and flows through the air open hole of the sealing plate 20 and enters the accommodation cavity 32, the exposure portions 28*a* are not exposed to the hydrogen gas since the exposure portions 28*a* of the piezoelectric layers 28 are covered and protected by the adhesive B. If the flow paths such as the pressure chambers 22 have been formed, a process of bonding the nozzle plate 16 to the flow path formation substrate 15 is performed (see FIG. 4).

In the recording head 3 according to the invention, if the shape (in particular, shape of the accommodation cavity 32) of the sealing plate 20 is changed only, the exposure portions 28*a* of the piezoelectric layers 28 can be protected while suppressing increase in cost without adding parts or processes. Accordingly, the invention can be applied to various liquid ejecting heads employing the configuration in which piezoelectric elements are sealed by the sealing plate. Further, in the printer 1 on which the recording head 3 is mounted, burnout of the piezoelectric elements 19 is suppressed, so that durability and reliability of the apparatus are improved.

It is to be noted that the invention is not limited to the above-mentioned embodiment. Further, the ink jet recording head mounted on the ink jet printer has been described as an example in the above-mentioned embodiment. However, the invention can be applied to heads that eject liquids other than ink as long as the piezoelectric elements having the above-mentioned configuration are used. For example, the invention can be applied to a coloring material ejecting head to be used for manufacturing a color filter of a liquid crystal display and the like, an electrode material ejecting head to be used for forming an electrode of an organic electroluminescence (EL) display, a field emission display (FED), and the like, a bioorganic compound ejecting head to be used for manufacturing a biochip (biochemical element), and the like.

What is claimed is:

1. A liquid ejecting head comprising:

a pressure chamber formation member on which a pressure chamber communicating with a nozzle is formed;

an actuator unit that includes a piezoelectric element formed by laminating a first electrode, a piezoelectric layer, and a second electrode in this order at a position corresponding to the pressure chamber and is laminated on the pressure chamber formation member; and a sealing member that is bonded to the actuator unit with an adhesive in a state where the piezoelectric element is accommodated in an accommodation cavity formed in the sealing member, wherein the piezoelectric element is extended to define an extended portion from a position corresponding to an opening of the pressure chamber to an outer position beyond an opening edge of the pressure chamber, and the piezoelectric layer includes an exposure portion from which the second electrode is removed on the extended portion, wherein the exposure portion of the piezoelectric layer is covered by the adhesive between the actuator unit and the sealing member; and wherein the exposure portion of the piezoelectric layer is located between a terminal portion, which is formed on an end portion of the extended portion of the piezoelectric element and is electrically connected with the first electrode, and the second electrode in an extension direction of the piezoelectric element.

2. The liquid ejecting head according to claim 1, wherein a metal film made of the same material as the terminal portion is formed on an end portion of the second electrode, and a surface of the metal film and a surface of the terminal portion are aligned on the same plane, and the bonding portion of the sealing member abuts against the metal film and the terminal portion across the exposure portion of the piezoelectric layer.

3. The liquid ejecting head according to claim 1, wherein: the sealing member is bonded to the actuator unit in a state where the piezoelectric element and second electrode are accommodated in the accommodation cavity formed in the sealing member, and the second electrode is a single continuous layer; and a bonded surface of the sealing member overlaps the second electrode.

4. The liquid ejecting head according to claim 1, wherein the sealing member is adhered directly to at least a portion of the second electrode.

5. The liquid ejecting head according to claim 4, wherein:

the first electrode is a lower layer below the piezoelectric layer;

the second electrode is an upper layer above the piezoelectric layer;

a side-edge of the portion of the second electrode that is adhered to the sealing member defines a side of the exposure portion of the piezoelectric layer; and the adhesive that covers the exposure layer of the piezoelectric layer also covers said side-edge.

6. The liquid ejecting head according to claim 5, wherein:

said liquid ejecting head further comprises a weight layer over a fraction of said upper layer; and the sealing member is further adhered directly to at least to a portion of the weight layer.

7. The liquid ejecting head according to claim 6, wherein:

the placement of the weight layer over the upper layer is offset from said side-edge of the upper layer to define an exposed offset surface on the upper layer between said side-edge of the upper layer and a starting edge of the weight layer;

the upper surface of the exposure portion of the piezoelectric layer, the side-edge and exposed offset surface of the upper layer, and the side and upper surface of the weight layer form a staircase pattern from the exposure portion of the piezoelectric layer to the upper surface of the weight layer; and the adhesive that covers the exposure portion of the piezoelectric layer also covers the staircase pattern including the offset surface on the upper layer and at least a portion of the upper surface of the weight layer.

8. A liquid ejecting apparatus including the liquid ejecting head according to claim 1.

9. A liquid ejecting apparatus including the liquid ejecting head according to claim 2.

* * * * *